US005150590A

United States Patent [19]

Ling

[11] Patent Number: 5,150,590

[45] Date of Patent: Sep. 29, 1992

[54] EJECTIVELY OPENABLE LATCH FOR LUGGAGE

[76] Inventor: Chong-Kuan Ling, c/o Sinox Co., Ltd. P.O. Box 96-156, Taipei, Taiwan

[21] Appl. No.: 689,541

[22] Filed: Apr. 23, 1991

[51] Int. Cl.[5] ..... E05B 65/52

[52] U.S. Cl. ..... 70/69; 70/70; 70/71; 70/289

[58] Field of Search ..... 70/67-76, 70/289; 292/252, DIG. 30, DIG. 37, DIG. 48

[56] References Cited

U.S. PATENT DOCUMENTS

| | | | |
|---|---|---|---|
| 2,399,302 | 4/1946 | Thiele | 70/70 |
| 3,310,970 | 3/1967 | Humphries | 70/70 |
| 3,392,556 | 7/1968 | Atkinson | 70/71 |
| 3,440,844 | 4/1969 | Constable | 70/70 |
| 3,736,778 | 6/1973 | Bako | 70/70 |
| 3,756,639 | 9/1973 | Wilkinson | 70/67 X |
| 3,975,933 | 8/1976 | Bako | 70/70 |
| 4,934,162 | 6/1990 | Rasch | 70/69 |

FOREIGN PATENT DOCUMENTS

| | | | |
|---|---|---|---|
| 2057807 | 1/1972 | Fed. Rep. of Germany | 70/69 |

*Primary Examiner*—Richard E. Moore
*Assistant Examiner*—Suzanne L. Dino

[57] ABSTRACT

A latch for luggage includes: a housing secured to a base case, a trigger slide slidably held in the housing having a lock core rotatably mounted in the trigger slide provided with a lock bolt operatively biased to be retarded by a limiting block formed in the housing for locking the trigger slide, and a hook latch secured to a cover coverable on the base case for forming a luggage or the like and lockably engageable with a recess portion formed in the trigger slide. The hook latch is normally urged by an ejecting spring formed in the trigger slide so that upon a disengaging of the hook latch from the trigger slide when unlocking the trigger slide, the hook and the luggage cover will be automatically ejected upwardly for a quick opening of a luggage.

3 Claims, 2 Drawing Sheets

EJECTIVELY OPENABLE LATCH FOR LUGGAGE

BACKGROUND OF THE INVENTION

A conventional latch for luggage or pocketbook as disclosed in U.S. Pat. No. 4,934,162 by Ulf Rasch taught a mechanism for preventing inversion (an upside down) of the luggage by forming an outwardly open cup 13 within the spring 4 defining a cavity holding a ball 14 in the cup 13 and by forming a projection or offcenter tongue 15 in the button 3 so that when inverting the luggage as shown in his FIG. 4, the projection 15 of the button 3 will be retarded by the ball 14 to prevent an unexpected opening of an inverted luggage.

However, such an inversion preventing means still has the following drawbacks:

1. The cup 13 has an outward opening so that the ball 14 may be easily escaped from the cup 13 into a spring chamber retained with the spring 4 to lose its inversion preventing effect.

2. When turning the luggage upside down, the ball 14 may be frictionally retarded by the transversely protruding projection 15 to be unable to reach a lower bottom portion in the cup 13 as shown in his FIG. 4, thereby influencing an inversion prevention effect thereof.

3. Even inverting the luggage as shown in his FIG. 4, a depression of the button 3 to inwardly strike the projection 15 on the ball 14 may possibly or accidentally bias the ball 14 upwardly into an upper portion in the cup 13 so that the projection 15 will no longer be retarded by the ball 14 to thereby lose its locking effect under an inverted condition.

The present inventor has found the drawbacks of such a conventional latch for luggage and invented the present latch having a precise inversion preventing means.

SUMMARY OF THE INVENTION

The object of the present invention is to provide a latch for luggage having a precise inversion preventing device for ensuring an upright openable position of a luggage which is ejectively opened as ejected by a spring held in a latch housing, and is unable to be opened when turning the luggage upside down.

DETAILED DESCRIPTION

Figure 1:
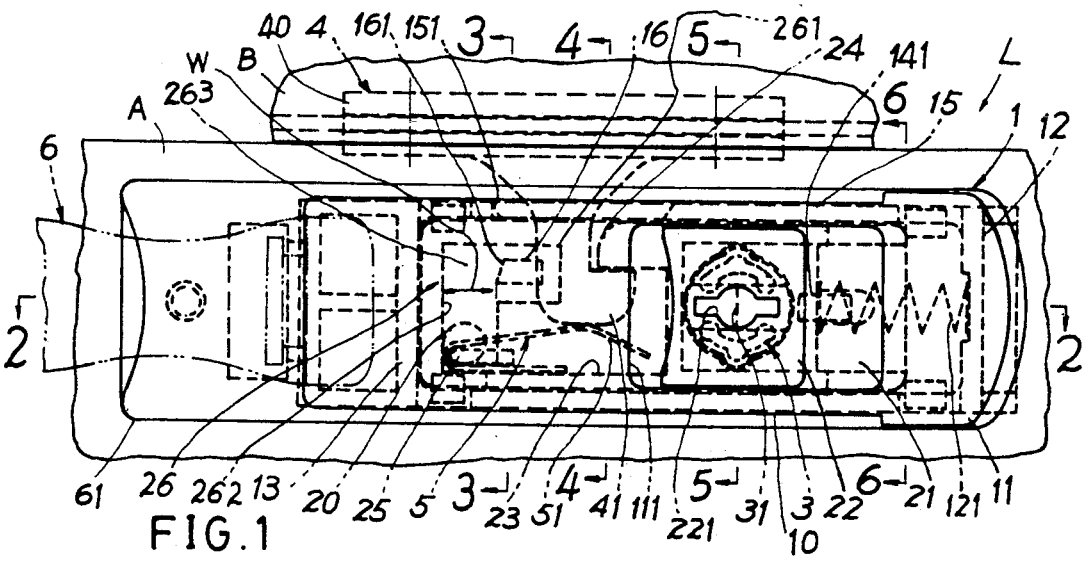
FIG. 1 is a front view illustration of the present invention.
Figure 2:
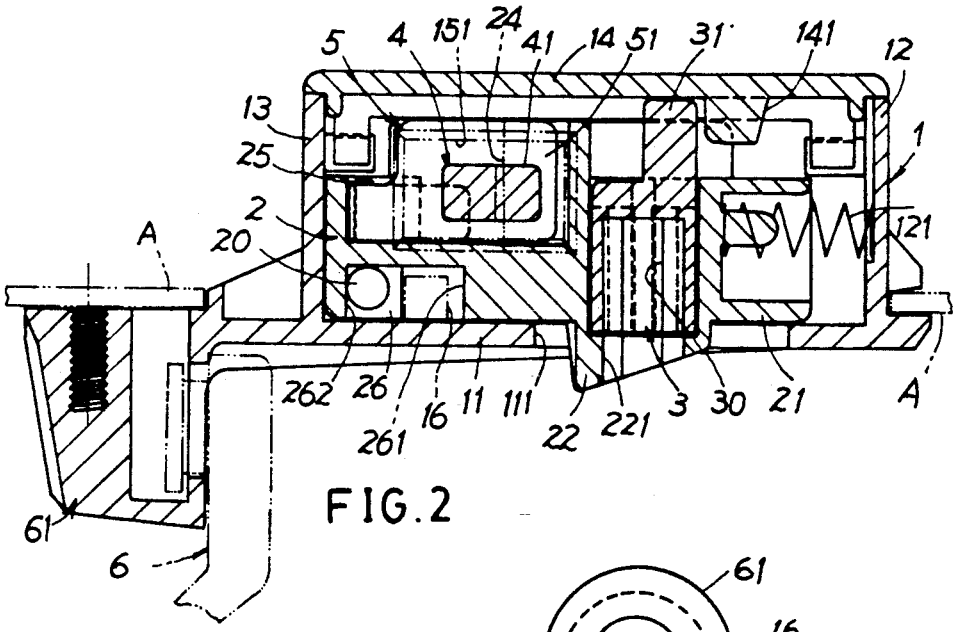
FIG. 2 is a sectional drawing of the present invention when viewed from 2—2 direction of FIG. 1.
Figure 3:
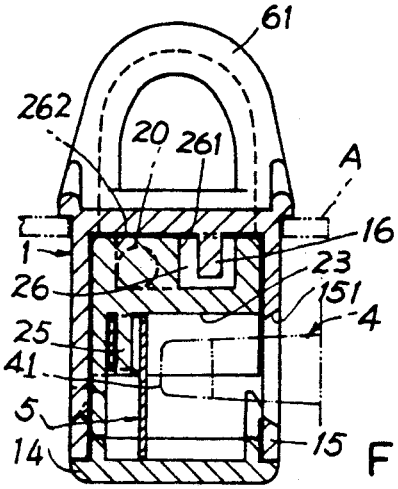
FIG. 3 is a sectional drawing of the present invention when viewed from 3—3 direction of FIG. 1.
Figure 4:
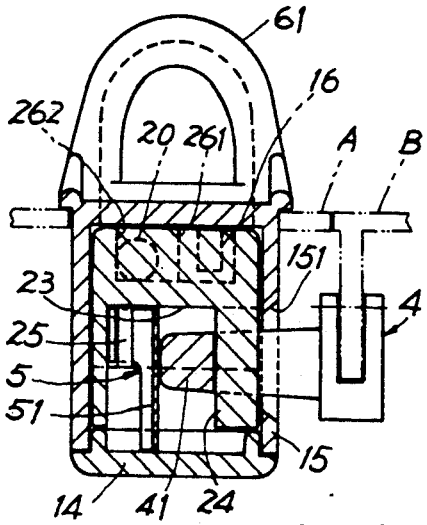
FIG. 4 is a sectional drawing of the present invention when viewed from 4—4 direction of FIG. 1.
Figure 5:
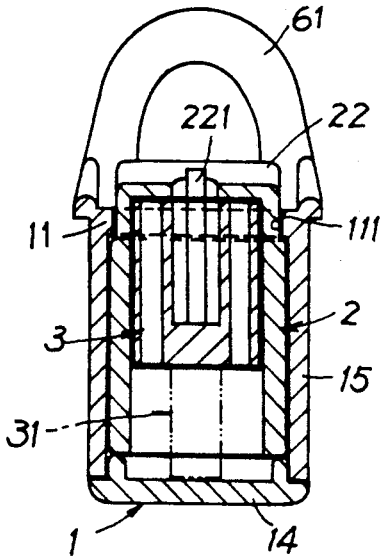
FIG. 5 is a sectional drawing when viewed from 5—5 direction of FIG. 1.
Figure 6:
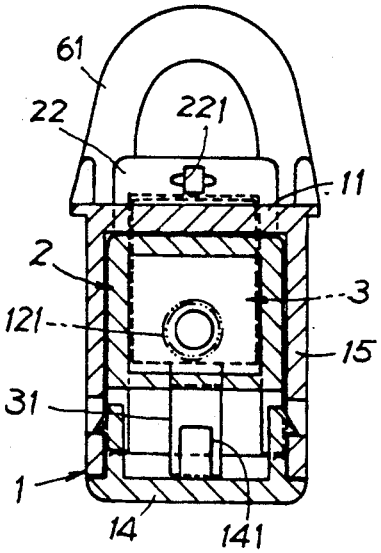
FIG. 6 is a sectional drawing when viewed from 6—6 direction of FIG. 1.

As shown in FIGS. 1–8, the present invention comprises: a housing 1 secured on a first luggage body or a base case A of a luggage L or the like, a trigger means 2 slidably mounted in the housing 1, a lock means 3 secured with the trigger means 2, a latch means 4 secured to a second luggage body or a cover B of the luggage L, and an ejecting spring 5 retained in the trigger means 2 for operatively ejecting the latch means 4 and the second luggage body B to be separated from the first luggage body A. A handle 6 is pivotally secured on a handle holder 61 mounted on the first luggage body A for portable purpose. The second luggage body B is pivotally combinable with or coverable on the first luggage body A to form a luggage.

The housing 1 generally parallelipiped shaped includes: a bottom plate 10 formed on a bottom portion of the housing 1 when keeping the luggage L at an upright position as shown in FIG. 1, a front plate 11 formed on a front portion of the housing 1 secured on a front surface portion of the first luggage body A, a rear plate 14 formed on a rear portion of the housing 1, a first side plate 12 formed on a side portion of the housing 1 such as approximating an outer side portion of the luggage 1, a second side plate 13 formed on an opposite side portion of the housing such as approximating a central or handle portion of the luggage, an upper plate 15 formed on an upper portion of the housing 1 adjacent to the second luggage body B, a limiting block 141 formed on a rear plate 14, and a wedge block 16 secured to the front plate 11.

The trigger means 2 includes: a push button 22 protruded frontwardly from a front portion 21 slidably held within the front plate 11 of the housing 1 through a button slot 111 formed in the front plate 11, a hook socket 23 formed in the trigger means facing the latch means 4, an engaging recess portion 24 formed in an upper portion of the socket 23 engageable with a hook portion 41 protruding downwardly from a latch base 40 of the latch means 4 secured on the second luggage body B through a latch hole 151 formed in the upper plate 15, a spring holder 25 formed in a lower portion of the socket 23 near the bottom plate 10 of the housing, an inversed-L-shaped ball slot 26 formed in a front portion in the trigger means 2 near the front plate 11 of the housing 1, and a restoring spring 121 retained on the first side plate 12 normally urging the trigger means 2 inwardly towards the second side plate 12.

The inversed-L-shaped ball slot 26 includes: a horizontal slot 261 having the wedge block 16 secured on the front plate 11 located in the horizontal slot 261, a vertical slot 262 perpendicular to the horizontal slot 261 for slidably holding a ball 20 in the vertical slot 262, and a right-angle corner portion 263 defined between the horizontal slot 261 and the vertical slot 262. The wedge block 16 includes a sloping surface 161 tapered downwardly towards the vertical slot 262 when the luggage is upright positioned and the sloping surface 161 being tapered downwardly towards the horizontal slot 261 proximate to the upper plate 15 of the housing 1 (FIG. 1A) when turning the luggage upside down. The sloping surface 161 of the wedge block 16 generally defines a width W between a vertical side wall of the vertical slot 262 within the right-angle corner portion 263 and the sloping surface 161 equal to a diameter of the vertical slot 262 for slidably moving the ball 20 having a diameter slightly smaller than the diameter of the vertical slot 262.

The ball 20, the inversed-L-shaped slot 26 and the wedge block 16 of the present invention commonly form an inversion preventing means for a luggage.

The lock means 3 includes a cylindrical lock core 30 mounted in the trigger means 2 having a key hole communicated with a button key hole 221 formed in the push button 22, and a lock bolt 31 eccentrically secured to a rear portion of the lock core 30 operatively rotatively biased outwardly to approximate a limiting block 141 formed on a rear plate 14 of the housing 1 for locking the trigger means 2 or rotatively biased inwardly to separate from the limiting block 141 ready for actuating the trigger means for opening the second luggage body (cover) B from the first luggage body (base case) A.

The ejecting spring 5 is retained on the spring holder 25 formed in a lower portion of the trigger means 2 having a free end portion 51 of the spring 5 normally urging the hook portion 41 of the latch means 4 upwardly as shown in FIG. 1.

The second luggage body B is closed on the first luggage body A by engaging the hook portion 41 of the latch means 4 with the engaging recess portion 24 of the trigger means 2 resiliently retained in the housing 1 by the restoring spring 121 and the lock means 4 is locked by inserting a key into a key hole of the lock core 30 to rotatively bias the lock bolt 31 outwardly to be retarded by the limiting block 141 in the housing 1 (FIG. 2) so as for locking the luggage of the present invention.

Figure 7:
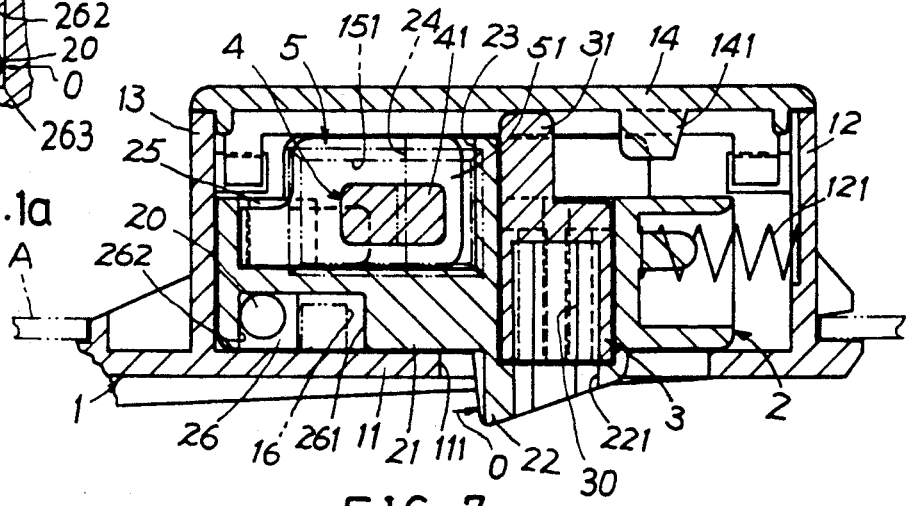
FIG. 7 is an illustration showing an unlocked luggage of the present invention.
Figure 8:
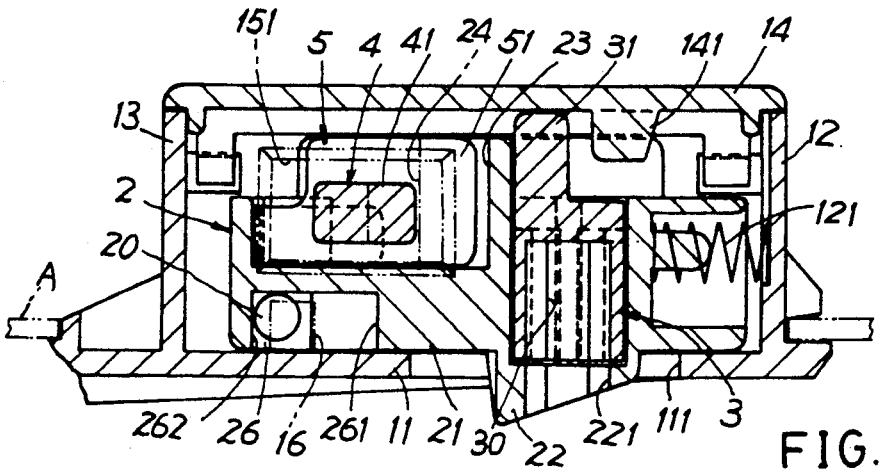
FIG. 8 shows an opening operation of the luggaged as unlocked in FIG. 7.

For opening a locked luggage of the present invention, a key is inserted into the lock means 3 for opening the lock and to rotatively bias the bolt 31 inwardly as shown in FIG. 7 to separate from the limiting block 141 so that upon an outwardly pushing of the push button 22 the recess portion 24 will be disengaged from the hook portion 41 which is then automatically ejected by the ejecting spring 5 for opening the latch means 4 so as for opening the second luggage body or cover B from the first luggage body or case A.

Figure 1A:
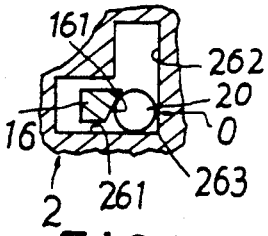
FIG. 1A shows an inversed condition of the present invention.

When the luggage is upright positioned as shown in FIG. 1, the ball 20 gravitationally drops to rest on a bottom portion of the vertical slot 262 of the inversed-L-shaped slot 26 so that a rightward pushing of the button 22 of the trigger means 2 for opening the latch of the present invention may not be obstructed by the wedge block 16 located in the horizontal slot 261, thereby sliding the trigger means 2 rightwardly for disengaging the hook portion 41 which is resiliently ejected by the spring 5 for quickly opening the luggage cover B. However, if the luggage is inverted (upside down) as shown in FIG. 1A, the ball 20 will drop in the corner portion 263 towards the horizontal slot 261 and upon a depression O of the button 22 for opening the latch, the trigger means 2 and the ball 20 will be retarded by the block 16. Since the sloping surface 161 is now tapered (diverging) downwardly towards the horizontal slot 261, a pushing of trigger means 2 will urge the ball 20 downwardly bearing a counter force acted by the sloping surface 161 of the block 16, thereby efficiently retarding the pushing of the button 22 of the trigger means 2 and preventing an unexpected inversion of the luggage. Therefore, an unexpected opening of an inverted luggage to outwardly spread inside contents stored in the luggage can be prevented.

The present invention can be suitably modified to be used in any kind of luggage, suitcase, briefcase, handbag, makeup kit, etc., which are not limited in this invention.

The present invention is superior to a conventional luggage latch with the following advantages:

1. The ball 20 is smoothly confined in the slot 26 of the inversion prevention means for ensuring an upright openable position of the luggage and for efficiently preventing an unexpected inversion of the luggage.

2. Upon an unlocking of the lock 3, the latch means 4 can be automatically ejected upwardly for a quicker and precise luggage opening operation.

I claim:

1. A latch for luggage comprising:

a housing secured on a first luggage body;

a trigger means slidably held in said housing including a push button protruded frontwardly from a front portion of the trigger means normally sidewardly urged by a restoring spring retained in a first side plate of said housing towards a second side plate of said housing opposite to said first side plate;

a lock means mounted in said trigger means including a lock bolt eccentrically secured to a rear portion of said lock means operatively rotatively biased towards said first side portion of said housing to be retarded by a limiting block formed in said housing for locking said trigger means or rotatively oppositely biased to separate from the limiting block ready for opening said trigger means;

a latch means having a latch base secured to a second luggage body pivotally combinable and coverable with said first luggage body, and a hook portion protruding downwardly to be lockable and engageable with a recess portion formed in a hook socket formed in said trigger means normally urged upwardly by an ejecting spring held in said socket of said trigger means, whereby upon an opening of said lock means for rotatively biasing said lock bolt to separate from said limiting block and a sliding of said trigger means to disengage the recess portion of said trigger means from said hook portion of said latch means, said hook portion will be resiliently ejected upwardly by said ejecting spring to automatically open said second luggage body from said first luggage body; and said trigger means including an inversion preventing means for preventing unlocking of the latch and locking means when turning a luggage upside down having an inversed-L-shaped ball slot formed in said trigger means including: a horizontal slot having a wedge block secured on a front plate of said housing located in the horizontal slot, a vertical slot perpendicular to the horizontal slot for slidably holding a ball in the vertical slot, and a right-angle corner portion defined between the horizontal slot and the vertical slot.

2. A latch according to claim 1, wherein said wedge block includes a sloping surface tapered downwardly towards the vertical slot when the luggage is upright positioned and the sloping surface being tapered downwardly towards the horizontal slot proximate to an upper plate of the housing when turning the luggage upside down.

3. A latch according to claim 2, wherein said sloping surface of the wedge block generally defines a width between a vertical side wall of the vertical slot within the right-angle corner portion and the sloping surface of the wedge block equal to a diameter of the vertical slot for slidably moving the ball having a diameter slightly smaller than the diameter of the vertical slot.

* * * * *